United States Patent [19]

Godlewski

[11] Patent Number: 4,550,902

[45] Date of Patent: Nov. 5, 1985

[54] STOCK FEEDING MACHINE

[76] Inventor: Edward S. Godlewski, 129 Spruce St., Wooddale, Ill. 60191

[21] Appl. No.: 517,621

[22] Filed: Jul. 27, 1983

[51] Int. Cl.[4] ..... B65H 3/32

[52] U.S. Cl. ..... 271/10; 271/19; 271/21; 271/42; 271/125; 271/233; 271/265; 271/273

[58] Field of Search ..... 271/10, 19, 21, 22, 271/42, 128, 130, 125, 171, 157, 265, 233, 273

[56] References Cited

U.S. PATENT DOCUMENTS

| | | | |
|---|---|---|---|
| 2,795,419 | 6/1957 | Ritzerfeld | 271/19 |
| 3,866,901 | 2/1975 | Brock | 271/21 |
| 4,026,538 | 5/1977 | Brown | 271/42 |
| 4,221,374 | 9/1980 | Koch | 271/19 X |

*Primary Examiner*—Richard A. Schacher

*Attorney, Agent, or Firm*—John J. Kowalik

[57] ABSTRACT

A feeding mechanism in which a reciprocating swab-like apparatus is provided wherein the pitmans are adjustable for beginning and ending their stroke by having the cranks driven by separable gears which may be meshed in different positions and wherein the pitmans are connected to a pair of counterrotatable wheels with friction facings engageable with paper sheets disposed in a stack therebeneath, the wheels being mounted on axes which are adapted to be canted to increase or reduce the area of engagement of the wheel periphery with the sheet to vary the amount of drag. The wheels are carried by a slider foot which is arranged to slide upon the sheet being moved. The wheels are arranged to move the sheet to be fed first into a registered position against a stop and then in the opposite direction to associated receiving mechanism.

13 Claims, 4 Drawing Figures

STOCK FEEDING MACHINE

BACKGROUND OF THE INVENTION

This invention pertains to feeding sheets of stock material, such as paper, in an accurate sequence and with proper spacing to an associated receiving mechanism such as a printer or laminator or the like. Such sheets particularly of large size were mostly hand fed and a conveyor sequenced the items to progress into the processing equipment. This type of system is slow and costly since it requires the constant attendance of an operator. Previously designed machines of the type under consideration and of reasonable cost have been inadequate or nonexistent.

SUMMARY OF THE INVENTION

This invention relates to novel sheet feeding machines which are readily attachable to conveyor components of existing processing equipment and which is of simple electrical-mechanical design and which eliminates conventional expensive, complex and troublesome vacuum pick-up mechanisms.

An object of this invention is to provide a novel feeder which feeds from the top of a stack and comprises a reciprocating device which on its feed stroke peels off the top sheet and advances it to the feeding nip of a retard assembly of a pull-out mechanism and on a return stroke moves the succeding sheet to a preset registered position from which is is next pulled and fed to the pull out mechanism.

A further object is to provide a novel feed mechanism which comprises a stock support tray disposed diagonally upwardly toward it upper discharge end, the lower end of the tray having a stop against which the trailing edges of the paper sheets are stacked and the leading edges of the paper being disposed adjacent the upper discharge end of the inclined tray, the feeder comprising a reciprocating element positioned above the stock and having a lower end provided with gripper wheels engaging the top sheet, one of the wheels being rotatable in one direction and only toward the stop and the other wheel being rotatable only in the opposite direction toward the discharge end of the tray, and thus as the reciprocating element moves back and forth one wheel drags the paper toward the stop while the other rotates and then as the reciprocating element reverses its stroke the previously rotating wheel stops and drags the paper toward the discharge end of the tray, while the previously non-rotating wheel rotates. This alternating rotation causes each sheet to be brought to the stop and then moved to discharge.

Broadly, the invention comprehends providing a mechanism which is adjustable to regulate the delivery of sheets of paper always starting each sheet from a precise initial position.

These and other objects and advantages inherent in and encompassed by the invention will become more apparent from the specification and the drawings wherein.

DESCRIPTION OF THE INVENTION

Figure 1:
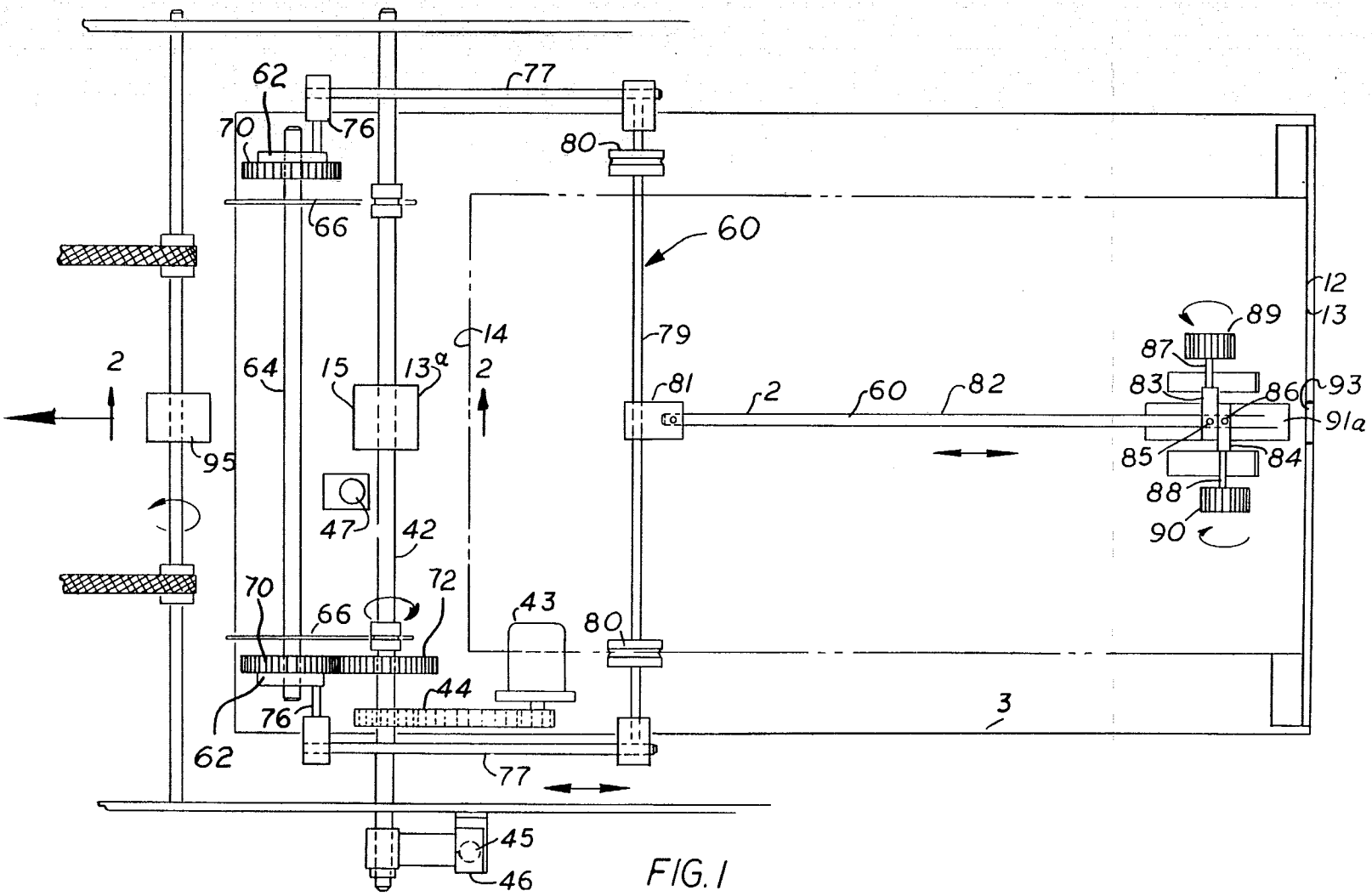
FIG. 1 is a top plan view of the novel feed mechanism with parts removed for clarity.
Figure 2:
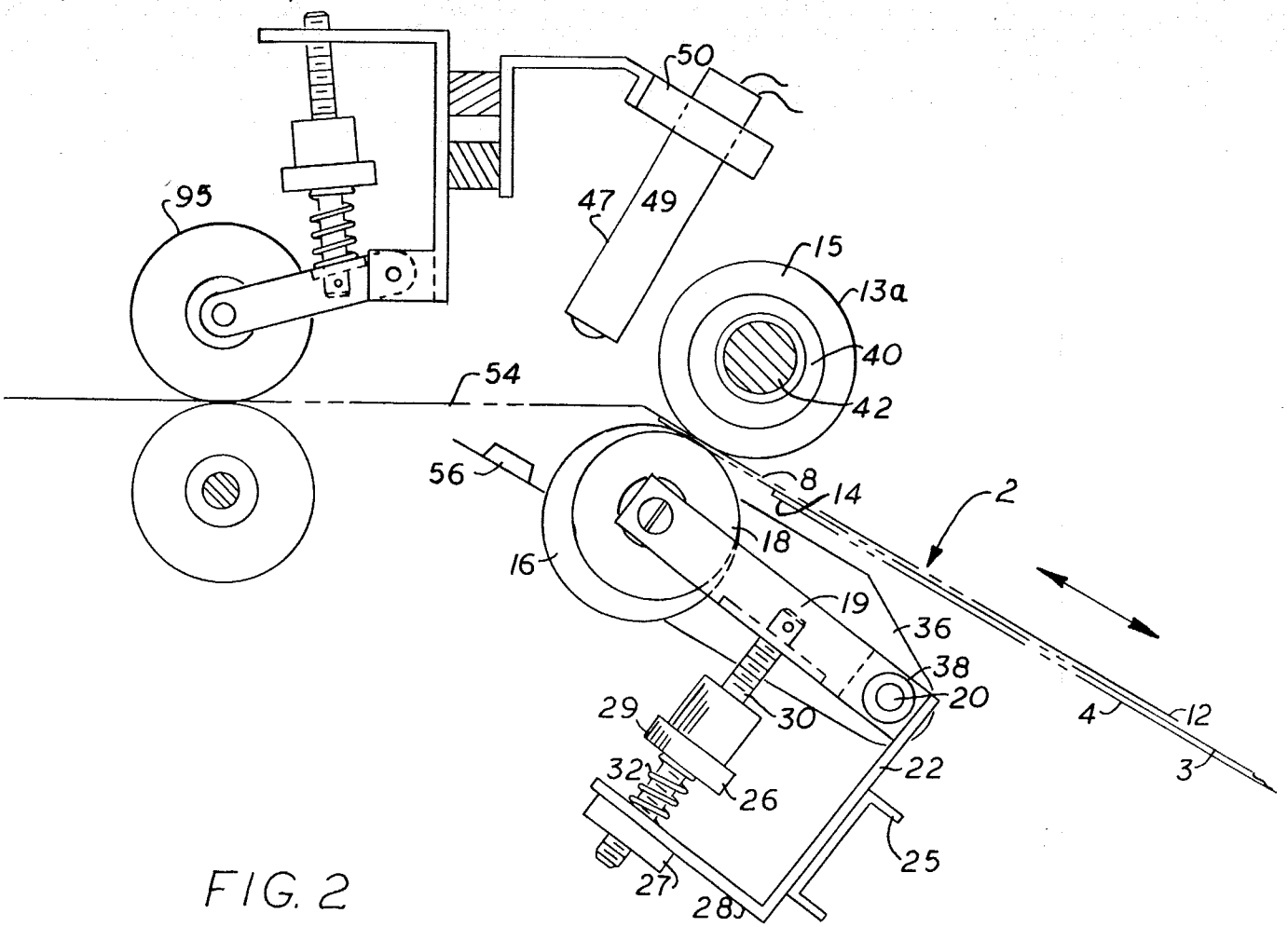
FIG. 2 is an enlarged fragmentary vertical sectional view taken substantially on line 2—2 of FIG. 1.
Figure 3:
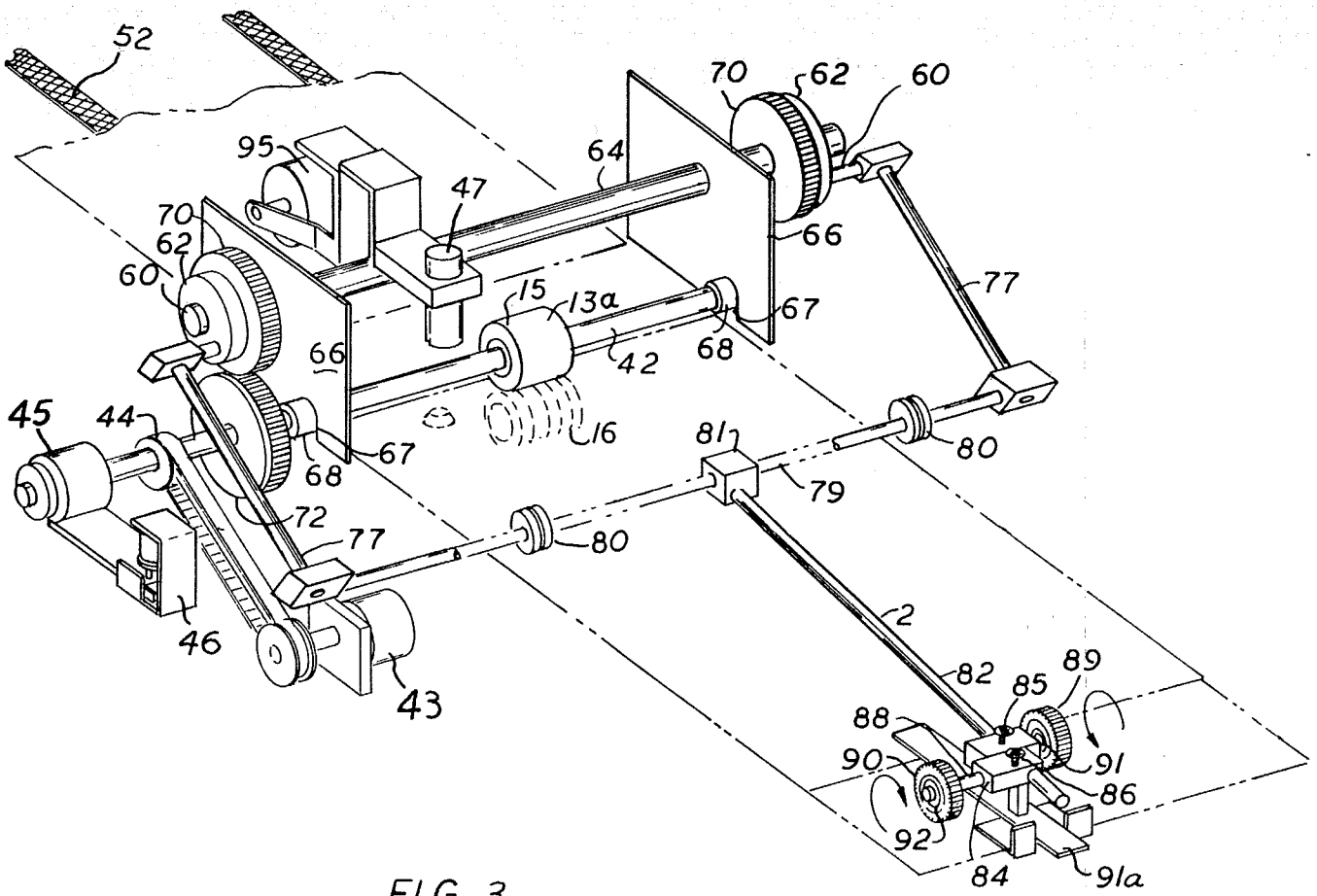
FIG. 3 is a fragmentary perspective view of the essential parts of the invention.

The feeding mechanism generally designated 2, comprises a tray 3 which has an inclined bottom wall 4 and a pair of laterally adjustable guide side rails 5 and 6 for confining the sheets 8 of a paper stack 10 positioned upon the bottom wall 4 in guided engagement with the side wall 5 and 6. The trailing edges 12 of the papers of the stack are seated against the interior of an adjustable stop or register wall 13 at the lower end of the tray.

Thus the stock items 8 are inclined in an upward direction toward their leading ends 14 which are positioned adjacent to the feed roller assembly **13*a* comprising peripherally engaged upper and lower feed rollers 15 and 16**.

The lower rollers flank a cylindrical nonrolling retard member 18 which is mounted on one end of an arm 19, the other end being pivotally mounted by a pin 20 from bracket 22 carried upon the framework 25 of the machine. The retard is urged upwardly toward the upper roller 15 and by a spring loaded assembly 26 which has a limit stop 27 engaged with the bracket leg 28. The spacing of the periphery of the retard is adjustable by rotaing the nut 29 on the lower end of shank 30 and the compression of the spring 32 which urges the arm 19 and retard 18 upwardly, is adjusted by nut 34 threaded on shank 30, the spring reacting at its top end against nut 29 and at its lower end against the top of leg 28 of the mounting bracket 22.

Each lower roller 16 is mounted on one end of the spring loaded arm 36, which is pivoted at its other end 38 to the bracket 22 and is urged upwardly toward the roller 15. Roller 15 is provided with a one-way clutch 40 which connects roller 15 with drive shaft 42 which is connected to any suitable power source 43 through a chain and sprocket drive 44 which drives a single revolution clutch 45 which is operated by a solenoid 46 coupled with and controlled by an electric eye 47.

The electric eye 47 is positioned downstream of the feed roller assembly **13*a* and comprises a light emitting section 49 mounted on a portion of the framework 50 of the conveyor 52 in a position above the path 54 of the paper flow. A reflector 54 is positioned below path 54 in alignment with the beam from the eye such that as each sheet passes between the light source 49 and the reflector, it interrupts the light beam. As the sheet moves downstream and its trailing or rear edge 12 passes beyond the reflector, the beam of the eye then bounces back and being in a circuit (not shown) with the solenoid 46, actuates the solenoid 46 of clutch 45 which then couples the power source with the shaft 42 driving it to pick up a sheet by assembly 13*a*, the sheet being advanced thereto by a reciprocating swabbing assembly 60**.

The swabbing assembly comprises a crank 62 at each end of a shaft 64 which is journaled in a pair of laterally spaced saddle members 66,66 which have inverted U-shaped sockets or slots which admit bearings 68,68 sleeved on drive shaft 42. Thus the assembly is easily liftable to engage and disengage the gears 70,72 connected respectively to the shafts 64,42.

Each gear 70,70 has the the crank 62 connected thereto, the throw 76 of which is rotatably journaled to one end of a pitman 77, and the other end of which is pivotally connected to a cross-head 79.

The cross-head 79 may be in the form of a rod which rotatably mounts a pair of grooved guide wheels 80,80 which ride on the upper edges of side walls 5 and 6 of the tray.

The cross-head is pivotally connected intermediate its ends through a bearing block 81 to the upper end of a secondary pitman 82 which at its lower end mounts a pair of mounting blocks 83, 84 which are adjustable along the length of the pitman rod 82 and adapted to be locked in position by set screws 85,86, respectively. Blocks 83,84 carry laterally extending stub shafts 87,88 which mount swab wheels 89,90 through one way clutches 91,92.

Figure 4:
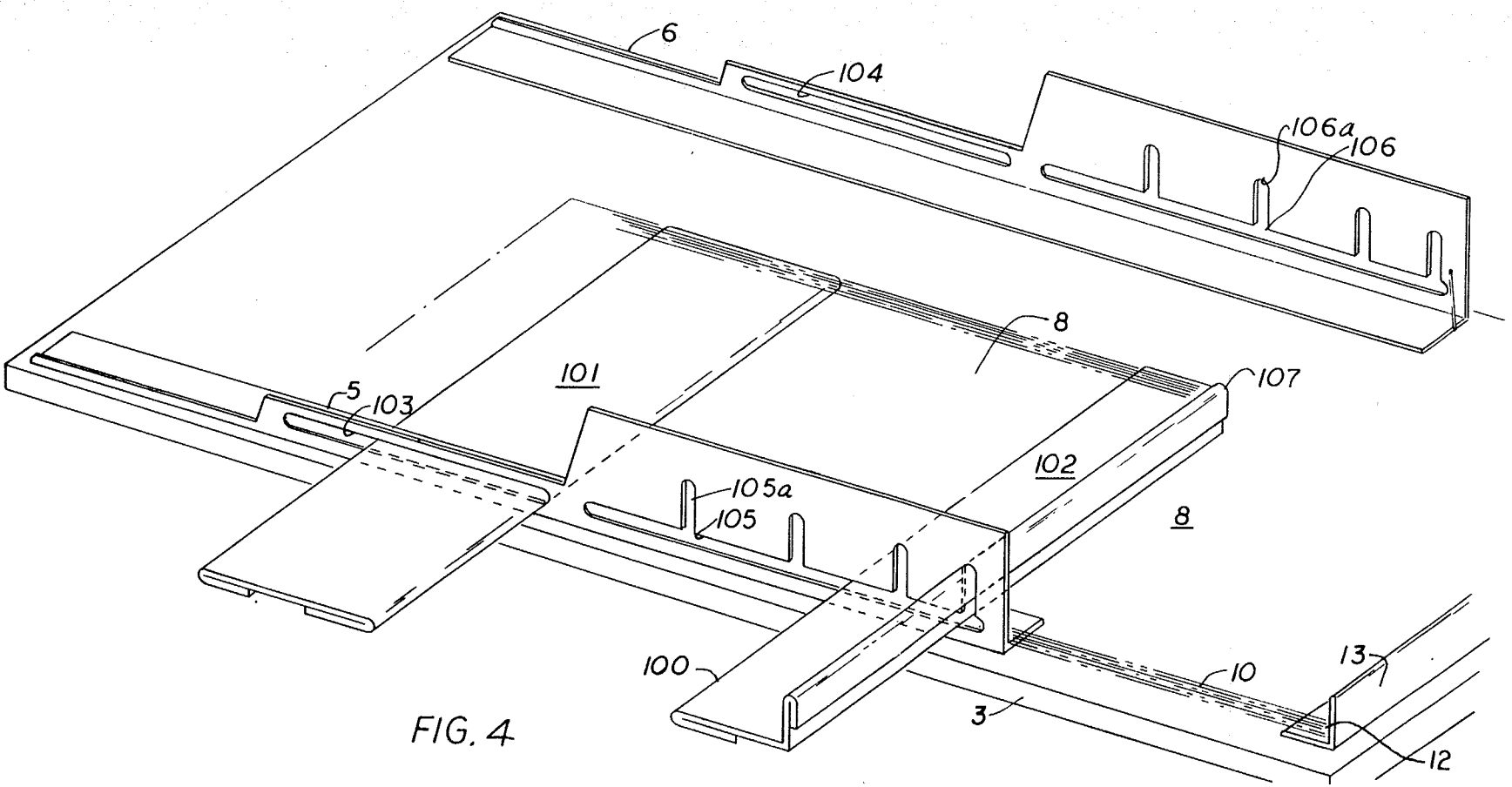
FIG. 4 is is a perspective view of the tray loader portion of the invention.

It will be noted that wheel 89 rotates in a counterclockwise direction as shown by the arrows in FIG. 4. The wheel 90 rotates only in a clockwise direction.

A hold-down slider foot 91*a* is carried by the pitman 82 via a block 84 adjacent to its lower end which projects through slot 93 in the stop end wall 13 of the tray agaist which the trailing edges of the stock sheets bear.

In operation, as the recipricator moves back and forth, the slotted wheel 90 is locked on the advance stroke of the swab assembly and being made of soft elastomeric material sloughs off from the stack of material the top sheet toward the retard and feed roller assembly 13*a* which grasps the advancing sheet and moves it to the pull-out roller assembly 95 of the conveyor. The roller assembly 95 continuously rotates and the one way clutch of the upper feed roller 15 and the free rolling of the lower rollers 16 accommodate pullout of the entire sheet once it enters and is grasped by the pull-out rollers.

On the return stroke of the swab assembly, the swab wheel 89 is locked against rotation and rubs against the sheet therebelow moving it to a feed-ready registered position whereat the trailing edge of the sheet abuts against the lower stop wall 13 of the tray. Any slight overtravel of the wheel 89 is accommodated by wheel 89 sliding over the sheet. The wheels are adjusted to bear only slightly on the paper sufficient to move the sheet without wrinkling it after is comes against the stop, or the retard. Thus the travel of each sheet and its start position is accurately controlled.

It will be noted that the travel positions of the pitman assembly is controllable by raising the swab assembly and the upper gears so as to disengage the gears 70 from the gears 72. The gears 70, 70 may then be rotated freely in either direction thus changing the position of the pitmans and the throws whereby the beginning advance and retract positions of the swab wheels are readily adjusted.

An auxiliary refill tray 100 is provided upon which a supply of sheets may be deposited while the equipment is running. The tray 3 comprises a pair of front and rear support plates 101 and 102 spaced longitudinally of the main tray. Plate 101 is inserted through laterally aligned slots 103,104 in the upright side walls of the main tray and plate 102 extends trough similar slots 105, 106 in the side walls 5 and 6. Slots 105,106 have upright sections 105*a* and 106*a* to accommodate the upright wall 107 of plate 102.

In use these plates are positioned in respective slots, and the additional sheets of paper are inserted under the cross-head onto the front and rear plates 101 and 102. These plates are withdrawn sidewise of the main tray and the additional paper falls upon the sheets therebelow. With practice many operators can add sheets without missing a stroke of the feed. The new load is dropped ahed of the swab wheels and the pushed hereunder.

The apparatus then continues to operate as before.

Having described a preferred embodiment of the invention, other embodiments will now become apparent which fall within the scope of the appended claims.

What is claimed is:

1. A feeding mechanism having a stack support means for supporting a stack of paper sheets having leading and trailing ends, register means at one end of said stack support means for engagement with the trailing ends of said sheets, and means for peeling the sheets of paper in the stack one by one from the top by sliding the top sheet into abutment with its trailing end against said register means and then sliding the same top sheet in the direction of its leading end into associated mechanism, and said peeling means comprising a pair of elastomeric wheels one rotatable in one direction toward the leading end of the sheet and the other in the reverse direction on the top sheet and operative as swabs.

2. The invention according to claim 1 and said support means comprising an inclined tray having lower and upper ends and said register means being disposed at said lower end and afoot on said peeling means slidable on the top sheet and operative to support said peeling means in preset pressing relationship with respect to said top sheet.

3. The invention according to claim 1 and pitman drive means for reciprocating said peeling means.

4. The invention according to claim 3 and means for adjusting the stroke phase of said pitman means for registering the same for delivering a sheet in phase with the conveying means.

5. The invention according to claim 4 and said support means comprising a tray having a pair of side walls having upper edges, and said pitman means comprising a crosshead and guide wheels journaled on said crosshead and tracking on the upper edges of said side walls of the tray.

6. A feeding mechanism for delivering in a predetermined path from a stack of papers individual sheets from the top thereof, a tray supporting said stack, conveying means disposed in receiving relation to said papers in the tray, means providing a registry stop against which each sheet is initially moved and from which to begin its feeding movement, means for swabbing each top sheet toward said registry stop to registry position for engagement of the trailing edge of the sheet to take up any excess motion of the swabbing means toward said stop, said swabbing means operative thereafter to swab against the registered top sheet in said feeding direction and move it into said conveying means, and said swabbing means comprising a crank and pitman drive including meshing driving and driven gears, means mounting said gears for movement between engaged and disengaged positions respectively coupling and uncoupling said gears for phasing the stroke of the pitman in phase with said conveying means.

7. In a metering device for delivering the top sheet from a stack of paper in a predetermined timed sequence to associated receiving means comprising:

an inclined tray having upper and lower ends and a bottom for supporting said stack with each sheet having a trailing end at the lower end of the tray and a leading end at the upper end of the tray, a registry stop at the lower end of the tray for engagement with the trailing ends of the sheets, means reciprocal over the top sheet between the ends thereof and including means for moving the top sheet initially into contact with its trailing end against said register stop and then in the opposite direction into said receiving means, and said moving means comprising a pair of elements for dragging the paper, and said elements comprising a pair of individually rotatable wheels with paper-engaging means thereon, one way clutch means mounting each wheel, and operative to restrict rotation of one wheel in one direction only and the other wheel in the opposite direction only as said wheels are reciprocated on said top sheet.

8. The invention according to claim 7 and said reciprocal means comprising a pair of cranks and pitmans connected to respective cranks, and means mounting the wheels from at least one pitman.

9. The invention according to claim 8 and said mounting means comprising means for adjusting the position of the wheels about axes transverse to their axes of rotation to positions generally parallel to the sheet engaged thereby and at selected angles thereto to vary the angular peripheral relation of the wheels to the sheet engaged thereby.

10. The invention according to claim 9 and said wheels each comprising a body of elastomeric material and said body being segmented into a plurality of flexible paper-engaging radial fingers.

11. In a metering device for delivering the top sheet from a stack of paper in predetermined timed sequence to associated receiving means comprising:

an inclined tray having upper and lower ends and a bottom for supporting said stack with each sheet having a trailing end at the lower end of the tray and a leading end at the upper end of the tray, a registry stop at the lower end of the tray for engagement with the trailing ends of the sheets, means reciprocal over the top sheet between the ends thereof and including means for moving the top sheet initially into contact with its trailing end against said registry stop and then in the opposite direction into said receiving means, and said moving means comprising a pair of elements for dragging the paper, and said receiving means comprising a conveyor including infeed rollers, and control means for actuating said rollers and said reciprocating means attendant to the passage of a sheet through said receiving means.

12. The invention according to claim 11 and said control means comprising an electric eye in the path of travel of said sheets of paper and a slave one way clutch for driving said receiving means.

13. In a metering device for delivering the top sheet from a stack of paper in a predetermined timed sequence to associated receiving means comprising:

an inclined tray having upper and lower ends and a bottom for supporting said stack with each sheet having a trailing end at the lower end of the tray and a leading end at the upper end of the tray, a registry stop at the lowr end of the tray for engagement with the trailing ends of the sheets, means reciprocal over the top sheet between said ends thereof and including means for moving the top sheet initially into contact with its trailing end against said registry stop and then in the opposite direction into said receiving means, and means for driving said reciprocal means including pairs of meshing gear means and parallel shafts mounting the same, and means for coupling and uncoupling said gear means including saddle members journalling the shaft of one of the pair of gear means on the shaft of the other pair of gear means and being separable from the other by lifting the shaft with said saddle members and said one pair of gear means.

* * * * *